United States Patent [19]

Ashikawa et al.

[11] 4,039,888

[45] Aug. 2, 1977

[54] IMAGE PICK-UP TUBE HAVING A PLURALITY OF ELECTRODES ON THE FACE-PLATE

[75] Inventors: Mikio Ashikawa; Iwao Takemoto, both of Tokyo, Japan

[73] Assignee: Hitachi, Ltd., Tokyo, Japan

[21] Appl. No.: 328,391

[22] Filed: Jan. 31, 1973

[30] Foreign Application Priority Data

Jan. 31, 1972 Japan ..... 47-10582

[51] Int. Cl. ..... H01j 31/26

[52] U.S. Cl. ..... 313/365; 313/283; 313/331; 313/376; 313/446

[58] Field of Search ..... 313/64 R, 65 R, 65 T, 313/69 C, 92 BI, 283, 329, 331

[56] References Cited

U.S. PATENT DOCUMENTS

| | | | |
|---|---|---|---|
| 3,379,822 | 4/1968 | Haans et al. | 313/331 X |
| 3,582,978 | 6/1971 | Petersen | 313/64 |
| 3,675,062 | 7/1972 | Flasche | 313/65 R |
| 3,714,488 | 1/1973 | Kato | 313/65 R |
| 3,721,752 | 3/1973 | Kakizaki | 178/5.4 F |

*Primary Examiner*—James W. Lawrence
*Assistant Examiner*—Saxfield Chatmon, Jr.
*Attorney, Agent, or Firm*—Birch, Stewart, Kolasch and Birch

[57] ABSTRACT

A face-plate of an image pick-up tube having a plurality of electrodes formed thereon and a plurality of conductors provided for external connection extending from said plurality of electrodes across the outer periphery of the face plate to the outer surface thereof. At least one of the plurality of conductors for said external connection comprises a thin film which is electrically insolated from the other conductors by a thin insulating film formed thereon. This thin insulating film also serves to seal, in an air tight manner, a vacuum envelope together with the conductor or conductors for external connection extending to the outer surface of the face-plate.

13 Claims, 10 Drawing Figures

IMAGE PICK-UP TUBE HAVING A PLURALITY OF ELECTRODES ON THE FACE-PLATE

BACKGROUND AND SUMMARY OF THE INVENTION

The present invention relates to an image pick-up tube, and more particularly to the construction of the external target connection for a plurality of electrodes formed on the inner surface of the face-plate of the image pick-up tube.

In the conventional vidicons, a target consisting of a transparent thin film electrode or signal-plate electrode and an extremely thin film of photoconductive material such as $Sb_2S_3$, Se,PbO or the like coated upon the transparent thin film electrode is formed upon the inner surface of the face-plate. The face-plate comprises a glass substrate and defines a light image incident window. Said face-plate is generally mounted on a vacuum glass tube through an annular ring made of a low-melting-point metal or alloy such as tin, indium or the like. The annular ring not only serves to seal the vacuum envelope in an air-tight manner, but also provides a target connection. The DC voltage is applied to the transparent thin film electrode on the face-plate through the target connection or signal electrode and the signal current is derived from the transparent thin-film electrode through the signal electrode.

In a color television camera using a vidicon, a plurality of transparent thin-film electrodes must be formed upon the inner surface of the face-plate in order to derive a plurality of different color video signals. Whereas in a camera for monochrome television, the annular metallic sealing ring serves as a signal electrode, as described above, in a color television camera the sealing ring must be divided into a plurality of segments which must be electrically isolated from each other so as to derive a plurality of color video signals. However, from the standpoint of maintaining a vacuum in the camera tube, the division of the annular sealing ring is not desirable. In order to overcome this problem in the conventional vidicons, metallic pins are placed in the vacuum envelope close to the target so as to provide the external connection for a plurality of transparent thin-film electrodes. However, this type of external connection increases the number of camera tube fabrication steps and associated defects because the metallic pins must be placed in the vacuum envelope and the electrical connection must be made between the electrodes on the face-plate and the metallic pins. The electric field near the target is thus adversely deformed because DC voltages are applied to the metallic external connection pins.

Furthermore, methods have been proposed for forming a field electrode in order to produce an optimum electrical field near the target, an electrode for preventing the secondary electron emission in the camera tube and an electrode for varying the potential applied to a localized area of the target. However, these methods have not been effectively employed in practice because of the difficulaty of providing the external connection for these electrodes.

One of the objects of the present invention is to provide an improved external connection means for a plurality of thin-film electrodes formed on the inner surface of the face-plate of an image pick-up tube.

Another object of the present invention is to provide a color television camera with a single electron gun which has a target constructed to derive a plurality of different color video signals, and an external connection means for a plurality of thin-film electrodes on the target.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

Pursuant to the present invention, a plurality of conductors are utilized for providing external connections for a plurality of thin-film electrodes disposed on the face-plate of an image pick-up tube. At least one of said plurality of conductors for external connection is in the form of a thin film which is electrically isolated from the other conductors by a thin insulating film. This thin insulating film serves to seal, in an air-tight manner, the vacuum envelope of the image pick-up tube together with the conductors for external connection extending from the thin-film electrodes formed on the inner surface of the face-plate to the outer surface thereof.

In another embodiment of the present invention at least one of the plurality of thin-film electrodes formed on the inner surface of the face-plate is a transparent thin-film electrode, and one pair of transparent thin-film electrodes are in the form of a comb which is arrayed in such a manner that the teeth of the pair of comb-shaped transparent thin-film electrodes are interleaved. A thin photoconductive film is coated on the transparent thin-film electrode so as to constitute a target. The photoconductive layer normally exhibits a high resistance so that a common continuous thin photoconductive layer may be formed all over the different transparent thin-film electrodes.

The electrodes formed upon the face-plate are not limited to the transparent electrodes, because some of them may be used to prevent secondary electron emission within the image pick-up tube, or to apply a predetermined voltage to a predetermined spot or localized area of the target thereby verying the spectral sensitivity.

The face-plate with the construction described may be mounted on a vacuum envelope made of insulating material through an annular sealing ring made of conductive material which is in contact with the thin insulating film. A conductive ring fitted over the vacuum envelope may serve as an external connection for one of the electrodes formed on the face-plate.

A plurality of transparent electrodes may be formed upon the inner surface of the face-plate in the form of multiple layers which are electrically isolated from each other by insulating layers or in a coplanar relation namely in monolayer so as to isolate all electrodes formed directly on the inner surface of the face-plate by adequate means. The comb-shaped transparent thin-film electrodes may be formed in a multilayer construction in such a manner that their teeth seem to cross each other when viewed in a direction normal to the face-plate.

The conductors used for the external connection of said plurality of thin-film electrodes formed on the inner surface of the face-plate are very simple so that the image pick-up tubes may be fabricated in a simple manner.

The above and other objects, features and advantages of the present invention will become more apparent from the following description of some of the preferred embodiments thereof taken in conjunction with the accompanying drawings. It should be understood that the following description is merely illustrative in nature rather than restrictive and that various variations and modifications within the scope of one skilled in the art are considered to be within the scope of the present invention.

DESCRIPTION OF THE PREFERRED EMBODIMENTS

Figure 1:
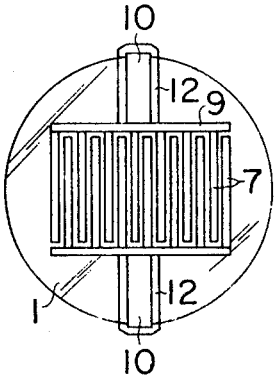
FIGS. 1, 3, 5, 7 and 9 are front views of various embodiments fo the face-plates with their targets, looking from an electron gun.
Figure 2:
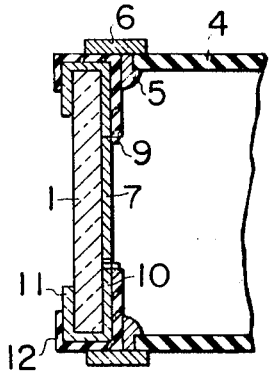
FIGS. 2, 4, 6, 8 and 10 are corresponding sectional views of said embodiments.

In the first embodiment of the present invention shown in FIGS. 1 and 2, comb-shaped transparent thin-film electrodes 7 are directly formed upon the inner surface of a glass face-plate 1. Each transparent thin-film electrode 7 may be formed by placing in intimate contact with the inner surface of the glass face-plate a metallic mask with apertures defining the comb-shaped transparent electrode 7 and spraying the mask with a solution of tin chloride dissolved in dilute hydrochloric acid in a heating furnace. This transforms the tin chloride into tin oxide at a temperature between 400° and 500°C. Alternatively, the techniques of photolithography may be used, wherein a thin metallic film such as a thin aluminum film is formed upon the inner surface of the glass face-plate by vacuum evaporation. Then portions of the thin-film corresponding to the desired comb-shaped electrode pattern are photoengraved and the whole surface is sprayed with a solution of tin chloride dissolved in hydrochloric acid in a heating furnace which converts the tin chloride into tin oxide at a temperature between 400° and 500°C. The thin aliminum chloride film is then dissolved with a suitable etchant thereby forming transparent thin-film electrodes of tin oxide.

Thereafter a thin silicon oxide film having a thickness of about 2,000–3,000 A is formed on the transparent thin-film electrodes 7 by the reaction between silane, $SiH_4$, containing nitrogen as a carrier gas and oxygen which is introduced separately at a temperature between about 400° and 500°C. Then the $SiO_2$ film is photoengraved to a desired pattern to form an insulating film 9.

In like manner a signal electrode 11 or conductor for external connection may be formed which leads a signal electrode 10 on the inner surface of the glass face-plate 1 to the outer surface thereof bridging across the outer periphery as shown in FIG. 2. A thin film insulating layer 12 extends along the inner surface of the signal electrode 10 to the outer surface of such electrode 11.

In the instant embodiment the conductor for external connection 11 leading the signal electrode 10 to the outer surface of the glass face-plate 1 may be formed upon the thin insulating film which in turn is formed so as to surround the light incident window. Therefore when the glass face-plate 1 is mounted upon a vacuum envelope 4 with an annular sealing means 5 of a low-melting-point metal, such as tin, indium or the like, the different conductors for external connection 11 may be provided upon the outer surface of the glass face-plate 1. In the first embodiment, even though the vacuum envelope 4 which can be made of an insulating material such as glass, is shown as being provided with a ring 6 made of a conductive material, it will be readily seen that the ring 6 is not used to provide any external connection for the comb-shaped transparent electrodes 7 on the inner surface of the face-plate 1.

Figure 3:
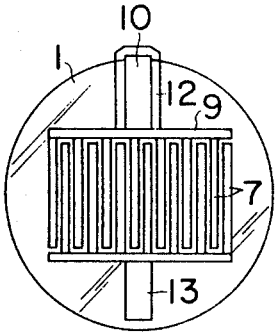
Figure 4:
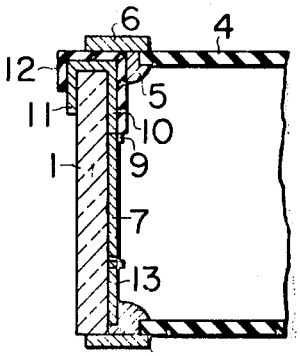

The second embodiment of the present invention shown in FIGS. 3 and 4 is substantially similar in construction to the first embodiment except that the conductive ring 6 is used as one of the signal electrodes. The other signal-plate electrode 10 is extended toward the outer surface of the glass face-plate 1 as shown in FIG. 4 in the manner as described above in connection with the first embodiment. One signal electrode 13 is formed by removing or etching a part of the insulating film surrounding the light incident window as shown in FIG. 3 and is electrically connected through the annular sealing means 5 made of a low-melting-point metal, to the conductive ring 6.

Figure 5:
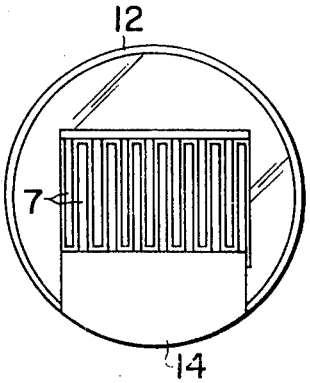
Figure 6:
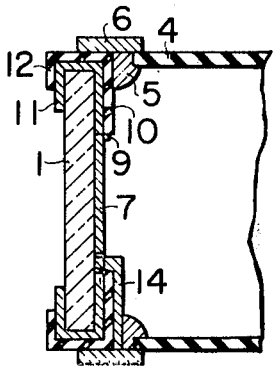

In the third embodiment shown in FIGS. 5 and 6, one signal electrode 10 is formed in the manner described in connection with the first embodiment so as to bridge across the glass face-plate 1 to the outer surface thereof as shown at 11 in FIG. 6. The other transparent thin-film electrode 7 is connected to the other signal electrode 14 formed upon the insulating thin-film layer 12. Therefore when the face-plate 1 of the third embodiment is mounted upon the vacuum envelope 4 the other signal electrode 14 is electrically connected through the annular means 5 of the low-melting-point metal to the conductive ring 6. Thus the signal electrode 11 on the outer surface of the glass face-plate 1 and the ring 6 of a conductive material fitted upon the vacuum envelope 4 serve as the exterior output signal terminals for an image pick-up tube or vidicon.

Figure 7:
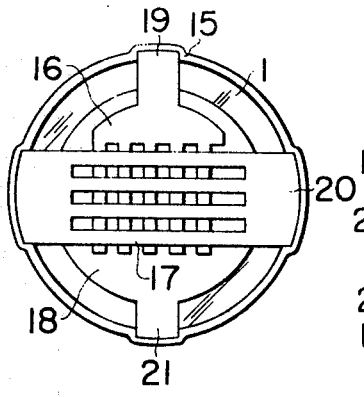
Figure 8:
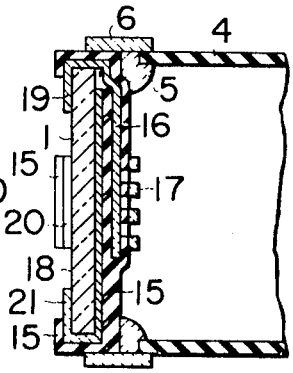

In the fourth embodiment of the present invention shown in FIGS. 7 and 8, three transparent thin-film electrodes 16, 17 and 18 are formed and electrically isolated from each other by a $SiO_2$ insulating film 15 which also serves to electrically isolate them from the conductive ring 6 and the sealing metal 5 of low-melting-point metal such as indium. The three transparent thin film electrodes 16, 17 and 18 are electrically connected to signal electrodes 19 and 20, and 21 respectively, which are also electrically isolated from each other by the $SiO_2$ insulating film 15. The two transparent thin-film electrodes 16 and 17 are in the form of a comb as in the case of the first, second and third embodiments, but they are crossed at right angles, as shown in FIG. 7. The transparent thin-film electrode 18 is formed directly over all the inner surface of the face-plate 1. Thus an electron beam can scan both the transparent thin-film electrodes 16 and 18 through the spaces between the teeth of the comb-like transparent thin-film electrode 17. As is well known in the art, the thin photo-conductive films exhibiting different spectral sensitivity characteristics are formed upon the transparent thin-film electrodes 16, 17 and 18 so that a single-electron-gun color television camera tube may be provided.

Figure 9:
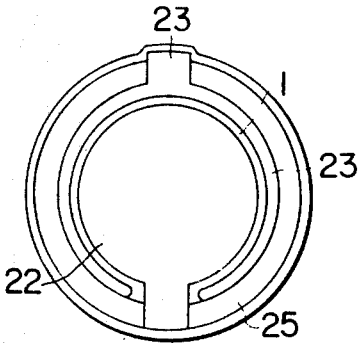
Figure 10:
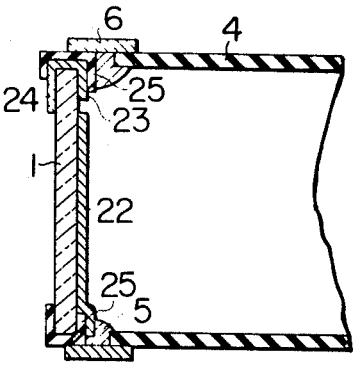

In a fifth embodiment of the present invention shown in FIGS. 9 and 10, in addition to a transparent thin-film electrode 22 formed upon the inner surface of the glass face-plate 1, there is formed a field electrode 23 which surrounds a target. A thin-film conductor path 24 is electrically connected to the field electrode 23 which bridges across the glass face-plate and extends over the outer surface thereof, in the manner described hereinbefore. Thus a suitable voltage may be impressed to the field electrode 23. The transparent thin-film electrode 22 is in electrical contact with the annular sealing means 5 made of a low-melting-point metal, such as indium, on the vacuum envelope 4 when the glass face-plate 1 is mounted thereon, so that the transparent thin-film electrode 22 can be electrically connected to the conductive ring 6 through the metallic sealing means 5. A thin insulating film 25 is formed so as to electrically isolate the field electrode 23 and its conductor 24 for external connection from the transparent thin-film electrode 22. The thin insulating film 25 also serves to seal the vacuum envelope 4 together with the annular sealing means 5 and the conductor 24.

It should be understood that the present invention may be also applied to forming an electrode for preventing the secondary electron emission or an electrode for applying a suitable voltage to a localized area of a target thereby changing the spectral sensitivity characteristics of that area.

The invention being thus described, it will be obvious that the same may be varied in many ways. Such variations are not to be regarded as a departure from the spirit and scope of the invention, and all such modifications are intended to be included within the scope of the following claims.

What is claimed is:

1. An image pick-up tube comprising a. a vacuum envelope made of an electrically insulating material, b. a transparent and optically flat face-plate made of electrically insulating material, said face-plate being associated with said vacuum envelope so as to define a vacuum side and a non vacuum side on opposite sides of said face plate, c. a plurality of electrodes formed on the inner surface of said face-plate and electrically insulated from each other, d. a plurality of conductive members bridging the face plate by extending between two different planes from the vacuum side of the face-plate in a first plane, through the vacuum envelope, around the outer peripheral edge of the face-plate to the non-vacuum side of the face-plate in a second plane, and thus having portions on both the vacuum side and non-vacuum side of said face plate, said conductive members providing external communication between said plurality of electrodes and the outer surface of the face plate, at least one of said plurality of conductive members being in the form of a thin film.

e. an annular sealing means made of a low-melting-point metal interposed between said vacuum envelope and said face-plate on the inside of the pick-up tube, and a ring of an electrically conductive material associated with the external end portion of said vacuum envelope and in electrical contact with the annular sealing means, and f. an insulating thin film associated with at least one portion of said thin-film conductive member and serving to seal hermetically said vacuum envelope and said face-plate together with the thin-film conductive member.

2. An image pick-up tube as set forth in claim 1, wherein at least one of said plurality of electrodes formed upon the inner surface of said face-plate is a transparent electrode, and said transparent electrode constitutes a target together with a thin photoconductive film formed thereon.

3. An image pick-up tube as set forth in claim 1, wherein said plurality of electrodes are formed upon the inner surface of said face-plate in a coplanar relationship.

4. An image pick-up tube as set forth in claim 1, wherein at least one of said electrodes formed upon the inner surface of said face-plate is in the form of a comb.

5. An image pick-up tube as set forth in claim 1, wherein at least two of said plurality of electrodes formed upon the inner surface of said face-plate are in the form of a comb, and the teeth of said at least two electrodes are interleaved.

6. An image pick-up tube as set forth in claim 1, wherein said plurality of electrodes are formed in multilayers upon the inner surface of said face-plate and are electrically isolated from each other by an electrically insulating layer.

7. An image pick-up tube as set forth in claim 6, wherein said plurality of electrodes are in the form of multilayers on the inner surface of said face-plate, and at least two electrodes belonging to different layers are so arrayed that their respective teeth are formed as two different layers which cross each other when looking at said face-plate in a direction normal thereof.

8. An image pick-up tube as set forth in claim 1, wherein said plurality of electrodes are transparent electrodes having photoconductive layers formed thereon.

9. An image pick-up tube comprising a vacuum envelope, an optically flat face-plate of electrically insulating material mounted in an air-tight manner at one end of said vacuum envelope, said face-plate being provided with a plurality of electrodes formed on the inner surface thereof, at least one of said plurality of electrodes being transparent and having a photoconductive film coated over at least one portion thereof, an electron gun assembly disposed within said vacuum envelope, a plurality of conductive members providing external connections between said plurality of electrodes on the vacuum side of the face-plate and the non vacuum side thereof, at least one of said plurality of conductive members for external connection being in the form of a thin film and extending from said one of said plurality of electrodes formed on the inner surface of said face-plate so as to extend between two different planes from the vacuum side of the face-plate in a first plane, through the vacuum envelope, around the outer peripheral edge of the face-plate to the non-vacuum side of the face-plate in a second plane for connection with an external lead, said thin film conductive member being electrically isolated from an annular sealing member and a conductive ring by a thin insulating film formed upon said at least one conductive member for external connection; and said thin insulating film serving to hermetically seal said vacuum envelope and said face-plate together with said at least one conductive member for external connection extending across the outer peripheral edge of said face-plate to the outer surface thereof.

10. An image pick-up tube as set forth in claim 9, wherein one of said plurality of conductive members for external communication comprises an annular sealing means made of a low-melting-point metal interposed between said vacuum envelope and said face-plate on the inside of the pick-up tube, and a ring of an electrically conductive material associated with the external end portion of said vacuum envelope and in electrical contact with the annular sealing means.

11. An image pick-up tube as set forth in claim 9, wherein an annular sealing means made of a low-melting-point metal or alloy is interposed between said vacuum envelope and said thin insulating film so as to hermetically seal said vacuum envelope and to serve as one of said conductive members for external connection with the external leads.

12. The image pick-up tube of claim 1, wherein said conductive members, which provide external communication, do so without penetrating the face-plate by extending from the transparent electrodes on the inner surface of the face-plate to the outer surface of said face-plate bridging across the outer periphery thereof.

13. The image pick-up tube of claim 12, wherein said thin insulating film serving to hermetically seal said vacuum envelope and said face-plate together with said conductive members for external communication also extends to the outer surface of said face-plate bridging across the outer periphery thereof.

* * * * *